US009511888B2

(12) United States Patent
Hearon

(10) Patent No.: US 9,511,888 B2
(45) Date of Patent: Dec. 6, 2016

(54) ADAPTER ASSEMBLY AND A PROCESS FOR SUPPLYING A STERILANT TO A PACKAGING SYSTEM FOR CLEANING AND FILLING OF PACKAGES

(71) Applicant: SOLVAY SA, Brussels (BE)

(72) Inventor: Matthew Hearon, Seabrook, TX (US)

(73) Assignee: Solvay SA, Brussels (BE)

( * ) Notice: Subject to any disclaimer, the term of this patent is extended or adjusted under 35 U.S.C. 154(b) by 68 days.

(21) Appl. No.: 14/356,796

(22) PCT Filed: Nov. 9, 2012

(86) PCT No.: PCT/EP2012/072206

§ 371 (c)(1),
(2) Date: May 7, 2014

(87) PCT Pub. No.: WO2013/068511

PCT Pub. Date: May 16, 2013

(65) Prior Publication Data

US 2015/0114513 A1 Apr. 30, 2015

Related U.S. Application Data

(60) Provisional application No. 61/698,106, filed on Sep. 7, 2012, provisional application No. 61/558,149, filed on Nov. 10, 2011.

(51) Int. Cl.
*B65B 55/10* (2006.01)

(52) U.S. Cl.
CPC ..... *B65B 55/10* (2013.01)

(58) Field of Classification Search
CPC ..... F17C 5/06; B65B 55/10
USPC ... 141/1, 2, 18, 85, 230, 312, 313, 323–326, 141/330–334, 346
See application file for complete search history.

(56) References Cited

U.S. PATENT DOCUMENTS

| | | | | |
|---|---|---|---|---|
| 2,718,344 | A * | 9/1955 | Troster | 141/86 |
| 3,019,932 | A * | 2/1962 | Singiser | 215/309 |
| 3,797,538 | A * | 3/1974 | Mollura | 141/313 |
| 4,737,320 | A * | 4/1988 | Rothschild | 261/64.3 |
| 4,823,848 | A * | 4/1989 | Sentmore et al. | 141/334 |
| 4,941,519 | A | 7/1990 | Sestak et al. | |
| 4,946,075 | A * | 8/1990 | Lundback | 222/181.3 |
| 4,979,655 | A * | 12/1990 | Gallucci | 222/519 |
| 5,152,431 | A * | 10/1992 | Gardner et al. | 222/136 |
| 5,186,358 | A * | 2/1993 | McVay | 222/1 |
| 5,293,913 | A * | 3/1994 | Preszler | 141/367 |

(Continued)

FOREIGN PATENT DOCUMENTS

| | | |
|---|---|---|
| EP | 1762252 A1 | 3/2007 |
| ES | 1076702 U | 4/2012 |

(Continued)

OTHER PUBLICATIONS

U.S. Appl. No. 14/343,865, Matthew Hearon, filed Mar. 10, 2014.

*Primary Examiner* — Timothy L Maust
*Assistant Examiner* — Andrew Schmid

(57) ABSTRACT

An adapter assembly and a process for supplying a sterilant to a packaging system for cleaning and filling of packages. Specifically, an adapter assembly for directly supplying a sterilant, such as hydrogen peroxide, from a packaging container, such as a blow-molded tight-head plastic packaging container, to the packaging system without using any intermediate carrier, such as a carboy.

21 Claims, 4 Drawing Sheets

(56) References Cited

U.S. PATENT DOCUMENTS

| | | | | | |
|---|---|---|---|---|---|
| 5,472,025 | A * | 12/1995 | Conrad et al. | 141/332 |
| 5,533,651 | A | 7/1996 | Eddy et al. | |
| 5,598,877 | A * | 2/1997 | Reidel | 141/346 |
| 5,682,931 | A * | 11/1997 | Mouchmouchian | 141/319 |
| 5,685,351 | A * | 11/1997 | Kazarian et al. | 141/325 |
| 6,202,717 | B1 * | 3/2001 | Markey et al. | 141/383 |
| 6,260,590 | B1 * | 7/2001 | Ziegmann | 141/332 |
| 6,371,443 | B1 * | 4/2002 | Imai | 251/149.6 |
| 6,536,188 | B1 | 3/2003 | Taggart | |
| 7,104,290 | B2 * | 9/2006 | Tseng | 141/65 |
| 7,213,622 | B2 * | 5/2007 | Sakraschinsky et al. | 141/326 |
| 8,220,666 | B2 * | 7/2012 | Abe | 222/181.2 |
| 8,973,625 | B2 * | 3/2015 | Liao | 141/332 |
| 8,978,935 | B2 * | 3/2015 | Heatley | 222/399 |
| 2005/0092392 | A1 * | 5/2005 | Abe | 141/374 |
| 2007/0277904 | A1 | 12/2007 | Martin | |
| 2011/0259847 | A1 * | 10/2011 | Cox et al. | 215/391 |
| 2012/0266567 | A1 | 10/2012 | Haesendonckx et al. | |
| 2014/0230953 | A1 * | 8/2014 | Hearon | 141/2 |
| 2015/0114513 | A1 * | 4/2015 | Hearon | 141/1 |

FOREIGN PATENT DOCUMENTS

| | | | | |
|---|---|---|---|---|
| GB | 2247451 | A * | 3/1992 | B65B 3/06 |
| JP | 2002274519 | A | 9/2002 | |
| KR | 20020022849 | A | 9/2002 | |
| TW | 025233 | B | 5/1979 | |
| WO | WO 94/11298 | A1 | 5/1994 | |
| WO | WO 02/62666 | A1 | 8/2002 | |
| WO | WO 2011/076167 | A1 | 6/2011 | |
| WO | WO 2011/104711 | A1 | 9/2011 | |
| WO | WO 2011/126981 | A2 | 10/2011 | |
| WO | WO 2013/037866 | A1 | 3/2013 | |

* cited by examiner

ADAPTER ASSEMBLY AND A PROCESS FOR SUPPLYING A STERILANT TO A PACKAGING SYSTEM FOR CLEANING AND FILLING OF PACKAGES

CROSS-REFERENCE TO RELATED APPLICATIONS

This application is a U.S. national stage entry under 35 U.S.C. §371 of International Application No. PCT/EP2012/072206 filed Nov. 9, 2012, which claims priority to U.S. provisional application No. 61/558149 filed on Nov. 10, 2011 and to U.S. provisional application No. 61/698106 filed on Sep. 7, 2012, the whole content of each of these applications being incorporated herein by reference for all purposes.

Should the disclosure of any patents, patent applications, and publications which are incorporated herein by reference conflict with the description of the present application to the extent that it may render a term unclear, the present description shall take precedence.

TECHNICAL FIELD

This invention relates to an adapter assembly and a process for supplying a sterilant to a packaging system for cleaning and filling of packages. Specifically, the present invention is directed to an adapter assembly for directly supplying from a packaging container, such as a blow-molded tight-head plastic packaging container, a sterilant, such as hydrogen peroxide, to the packaging system without using any intermediate carrier, such as a carboy.

STATE OF THE ART

Aseptic packaging, which is a well known method of packaging various products such as food, beverages, etc., can be defined as the filling of a commercially sterile product into a sterile package under aseptic conditions and hermetically sealing the packages so that re-infection is prevented. This results in a product, which is shelf-stable at ambient conditions.

Aseptic packaging requires special treatment and handling of the product as well as all of the equipment that contacts the product until it is hermetically sealed inside the package. This process includes the destruction of all molds, yeasts and pathogens of concern for the specific product. Common sterilants employed in the process for attaining this commercial sterility include steam, heated air, and chemicals. Thus, it is known to produce sterilized packaging in which a sterile food product is placed in a sterilized package such as a pouch, a bottle, a laminated paper carton or another product package. The product is thus preserved for later storage or use. Various methods of sterilizing the product package or material used to make the product package, and filling the package with a sterilized product, are known.

These methods are usually conducted by the manufacturer and/or filler of the packages in a system or device for sterilizing and aseptic filling of packages which will be referred to in the following as aseptic packaging system.

Conventionally the sterilant, such as hydrogen peroxide, is supplied by the manufacturer of the sterilant to the manufacturer and/or filler of the aseptic packages in a standard package such as a drum, pail, intermediate bulk container (IBC), or in bulk. The sterilant is then pumped, manually poured, or otherwise transferred to a carboy. The carboy is generally made of stainless steel and has an interface, which is designed to mate with a corresponding interface of the aseptic packaging system. The carboy with the sterilant is then carried to the aseptic packaging system and placed inside a cabinet thereof where the interfaces are connected to each other. Depending on the model of the aseptic packaging system the sterilant is then either pumped out of the carboy into the packaging system, e.g., with a pumping means, or it is supplied into the packaging system by a slight overpressure which is applied to interior of the carboy.

However, such use of a carboy for intermediate transfer of the sterilant makes the entire process time-consuming and renders the automated control difficult. In addition, the sterilant is frequently contaminated during the transfer to the aseptic packaging system, which also affects the quality of the final product. Furthermore, during the transfer and especially when manually pouring or pumping the sterilant a participating personnel may be exposed to the sterilant. This may lead to safety incidents if the sterilant is harmful or if a contaminated sterilant will become unstable and thus result in injury or equipment damage due to decomposition. The same problems arise in extended shelf-life packaging systems.

U.S. Pat. No. 4,941,519 discloses in FIG. 10 an apparatus for dispensing a liquid, particularly hydrogen peroxide, from a non-reusable container into equipment, the container having an externally threaded neck surrounding a container opening. The apparatus comprises an insert for insertion into the container neck having a dispensing passage and at least one venting or pressurizing passage. In addition the apparatus comprises a dip tube communicating with the dispensing passage the dip tube being fitted to the insert. A gasket is disposed between the insert and the rim of the container neck. The insert is provided with a unitary screw thread for engagement with the externally threaded neck of the packaging container.

SUMMARY OF THE INVENTION

One object of the invention is to dispense with the above mentioned disadvantages and to supply the sterilant to the packaging system without intermediate transfer into a carboy. Another object of the invention is to provide means for supplying the sterilant directly from the packaging container filled by the manufacturer of the sterilant into the packaging system in order to more effectively establish clean, in particular aseptic environment in the packaging system without any safety or contamination issue.

In order to achieve these objects the present invention provides an adapter assembly according to claim 1 and a process according to claim 11.

With the adapter assembly and process according to the invention it is possible to supply the sterilant directly from a standard and readily available packaging container with an internally threaded neck surrounding a container opening and with an externally threaded bung plug for sealing the container opening, in particular from a blow-molded tight-head plastic packaging container, into the packaging system without any intermediate transfer.

To this end the bung plug of the packaging container is removed and is replaced by the adapter assembly according to the invention which comprises: a unitary adapter body, a dip tube and a gasket, wherein the adapter body has a first tubular body portion, a second tubular body portion and a collar portion intermediate the first and second tubular body portions, wherein the dip tube is fitted to a first end of the first tubular body portion, wherein the adapter body has a dispensing passage extending through the first tubular body portion and communicating with an interior passage of the dip tube and further has at least one venting or pressurizing passage extending through the first tubular body portion and communicating with an annular space between an exterior surface of the dip tube and an interior surface of the second tubular body portion, wherein the second tubular body portion has an external thread for engagement with the internally threaded neck of the packaging container, and wherein the gasket surrounds the second tubular body portion and abuts to the collar portion.

The dispensing passage extending through the adapter body is for dispensing the sterilant from the packaging container to the packaging system whereas the at least one venting or pressurizing passage extending through the adapter body is for venting the packaging container during the supply of the sterilant from the packaging container to the packaging system or for applying an overpressure to the interior of the packaging container for displacing the sterilant from the packaging container to the packaging system by means of the overpressure in the packaging container.

The dip tube extends trough the container opening into the container where its lower end is located close to the container bottom in order to be able to almost completely empty the packaging container in an upright position of the packaging container.

The collar portion of the adapter body is for pressing the gasket against the rim of the opening of the packaging container when the externally threaded second tubular body portion of the adapter body is screwed into the internally threaded neck of the packaging container in order to sealingly close the packaging container except for the dispensing passage and the at least one venting or pressurizing passage.

In order to replace the bung plug of the packaging container with the adapter assembly and to supply sterilant directly from the packaging container into the packaging system, the process according to the invention comprises the steps of: removing the externally threaded bung plug from the internally threaded neck of the packaging container, sealingly attaching the adapter assembly to the packaging container by engagement of the external thread of the second tubular portion of the adapter body with the internally threaded neck of the packaging container after introducing the dip tube into the container opening, connecting an interface of the packaging system to the first tubular body portion of the adapter body, and then supplying the sterilant directly from the packaging container through the adapter body into the packaging system.

With the adapter assembly and the process according to the invention, it is thus possible to significantly reduce the necessary manual labor and risks as well as a contamination of the sterilant from the environment and to simplify the supply of the sterilant to the packaging system. It has been found that the use of the adapter assembly and the process according to the invention allow the user to supply the sterilant provided by the manufacturer directly from the packaging container into a packaging system, and the process of transferring the sterilant using an intermediate container such as a carboy is eliminated. Thus, the adapter assembly and the process of the present invention provide an improvement where the manual labor is reduced and where the quality of the sterilant is improved since contact with the environment is avoided or minimized. In addition to that there are no risk and safety issues compared with a manual transfer to a carboy.

BRIEF DESCRIPTION OF THE DRAWINGS

The present invention is illustrated by reference to the drawing figures, encompassing different views of a preferred embodiment of the invention, wherein.

DETAILED DESCRIPTION

Figure 1:
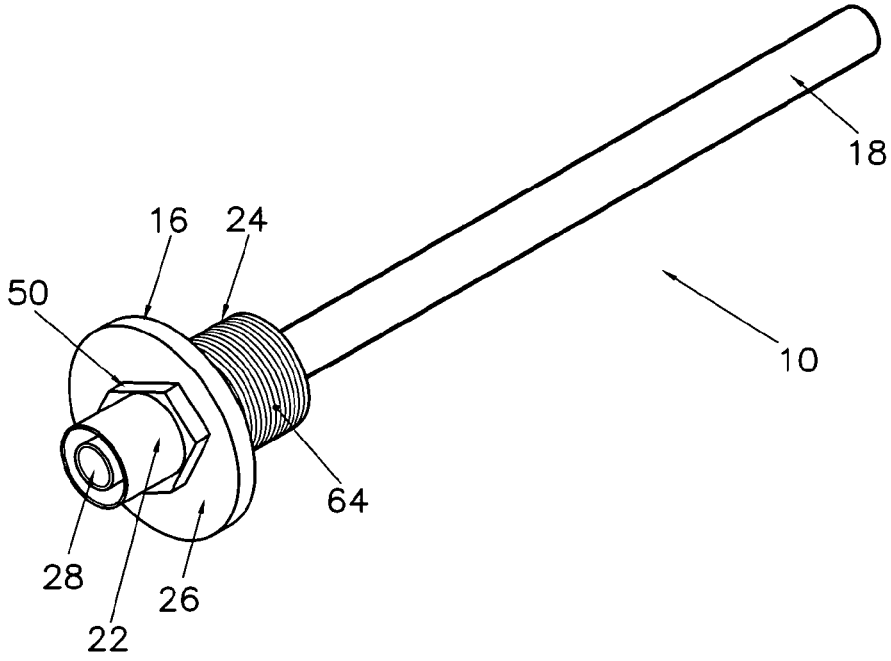
FIG. 1 is a perspective view of an exemplary adapter assembly according to the present invention for directly dispensing a sterilant from a packaging container.

The "packaging system" can be an aseptic packaging system for sterilizing and aseptic filling of packages. Alternatively the packaging system can be an extended shelf-life packaging system.

The term "aseptic" herein refers to a system and/or a process wherein a commercially sterilized package or packaging material, e.g., a bottle or a pouch or a laminated paper carton constructed in a vertical form/fill/seal process, is filled with a commercially sterilized product, e.g., a food product, in a hygienic environment. The product is thus rendered shelf stable in normal nonrefrigerated conditions. The package or packaging material, and the product, are typically separately sterilized before filling.

The expression "commercially sterile" herein refers to a level of sterility in packaged foods where they are not completely sterile but where they do not contain microorganisms that could cause health problems.

As already mentioned, the term "aseptic packaging system" refers to a system or device for sterilizing and aseptic filling of packages, such as pouches, bottle, laminated paper cartons or other product packages.

The sterilization and aseptic filling of the product packages, which is also referred to as "aseptic packaging", comprises (i) sterilization of the products before filling, (ii) sterilization of packaging materials and closures before filling, (iii) sterilization of aseptic installations before operation, (iv) maintaining sterility in this total system during operation and sterilization of all media entering the system, like air, gases, sterile water, and (v) production of hermetic packages. Such aseptic packaging is described in detail in U.S. Pat. No. 6,536,188 which is incorporated herein by its entirety by reference.

Extended shelf-life (ESL) processing is normally processed using sterilization times and temperatures to effect sterilization. However, this product is most likely filled and sealed using a filler that has not received FDA validation. Therefore the final product cannot be stored and distributed at room temperature. ESL products are normally filled at or near a refrigerated temperature for storage and distribution. How much shelf-life extension is gained by these ultra-clean techniques varies with the nature of the product being filled, but it is common to see a shelf-life extension from 25 to 100 days for dairy-based products.

For sterilization and shelf-life extension, a number of sterilants in a liquid, powder or gaseous form, preferably in a liquid form, are used in packaging systems, such as various acids, ethanol, oxides such as ethylene oxide and hydrogen peroxide and peracetic acid, preferably peroxides, and more preferably hydrogen peroxide or its solutions, most preferably an aqueous solution of hydrogen peroxide with a concentration of from 30 to 35%. Such aqueous solution of hydrogen peroxide is described in detail in European Patent Publication No. EP 1 762 252, which is incorporated herein in its entirety by reference. Hot air of a temperature of for example from 60° C. to 125° C. can later be used to dissipate residual hydrogen peroxide, and to increase the sporicidal activity of hydrogen peroxide since its activity increases substantially with increasing temperatures.

The package materials used in the packaging system may be any materials which meet the following requirements regarding compatibility with aseptic or extended shelf-life packaging: the material must be compatible with the product intended to be packed and comply with applicable material migration requirements and has physical integrity of the package which is necessary to assume containment of the product and maintenance of sterility. The package material must also be able to withstand sterilization and be compatible with the methods of sterilization, and the package must protect the product from oxygen, also the package must retain the aroma of the product. Such materials include, but are not limited to, paper, metallic film such as aluminum foil or metalized films, polyolefins such as polyethylene, polypropylene, polyvinylidene chloride, polystyrene, polyvinyl alcohol, acrylic polymers, condensation polymers such as Nylon and other polyamides, their copolymers, and combinations thereof. In a specific embodiment, a plurality of layers having different materials may be used where each layer provides each specific function. One example of such multilayered package is a laminated paper-aluminum-foil-plastic container developed by Tetra Pak®.

According to a preferred embodiment of the invention, the sterilant is supplied by the manufacturer of the sterilant in a commercial packaging container the dimensions of which are such that it can be placed in the cabinet of the packaging system instead of a carboy.

Preferably, the commercial packaging container is a blow-molded tight-head plastic packaging container, most preferably a tight-head packaging container, which meets UN packaging type 1H1 requirements and is commonly used for transporting hydrogen peroxide in aqueous solution. The internal thread of the container neck is a preferably 50 mm 6 thread-per-inch buttress thread and accordingly, the second tubular body portion of the adapter body preferably will have a 50 mm 6 thread-per-inch external buttress thread, in order to provide for a tight engagement of the external and internal threads.

A tight engagement of the external and internal threads can also be facilitated by means for tightening the externally threaded adapter body with respect to the internally threaded container neck, preferably in the form of a zone of the first tubular body portion having a hexagonal exterior cross-section. Advantageously, this zone is provided on the first end of the first tubular body portion, i.e., the end adjacent the collar portion. Alternatively, the first tubular body portion may have two flat regions machined therein to use for wrench tightening.

In order to match the adapter assembly with existing interfaces of packaging systems, the first tubular body portion of the adapter body preferably has four venting or pressurizing passages spaced in 90°-intervals and arranged radially outwardly from the central dispensing passage. In addition, advantageously a second end of the first tubular body portion opposite from the first end is provided with an annular groove where the four venting or pressurizing passages terminate. Furthermore, the second end of the first tubular body portion is provided with an external thread for connection to the interface of an aseptic packaging system.

In order to retain the gasket in its position around the second tubular body portion of the adapter body when the adapter assembly is not in use on a packaging container, the gasket can be adhered or molded to the collar portion of the adapter body. Advantageously, the gasket is a flat gasket having planar upper and lower surfaces, the former preferably being adhered or molded to an opposing planar lower surface of the collar portion.

The adapter body, the dip tube and the gasket can be independently made from any appropriate material which is capable of withstanding a sterilant at the aseptic conditions under which the adapter assembly is used. Non-limiting examples of such materials for the adapter body and the dip tube, i.e., the entire adapter assembly with the exception of the gasket, include polymeric and metallic materials, preferably polyethylene or polypropylene and most preferably stainless steel such as 316 stainless steel in view of its commercial availability as well as durability against a number of chemicals. Although any suitable material may be used for the gasket, non-limiting examples include elastomers, preferably elastomeric polymers which are resistant to sterilants.

If the unitary adapter body and the dip tube are made of stainless steel for the assembly of the dip tube to the adapter body, preferably an upper end of the dip tube is welded into a socket of the first end of the first tubular body portion.

Figure 2:
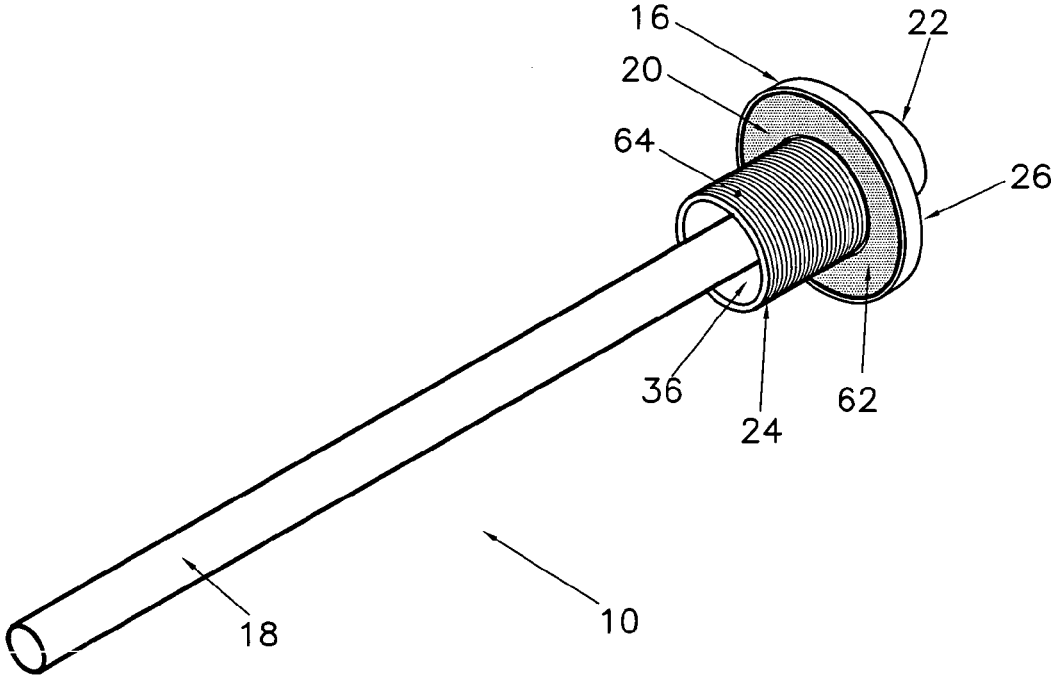
FIG. 2 is another perspective view of the adapter assembly.
Figure 3:
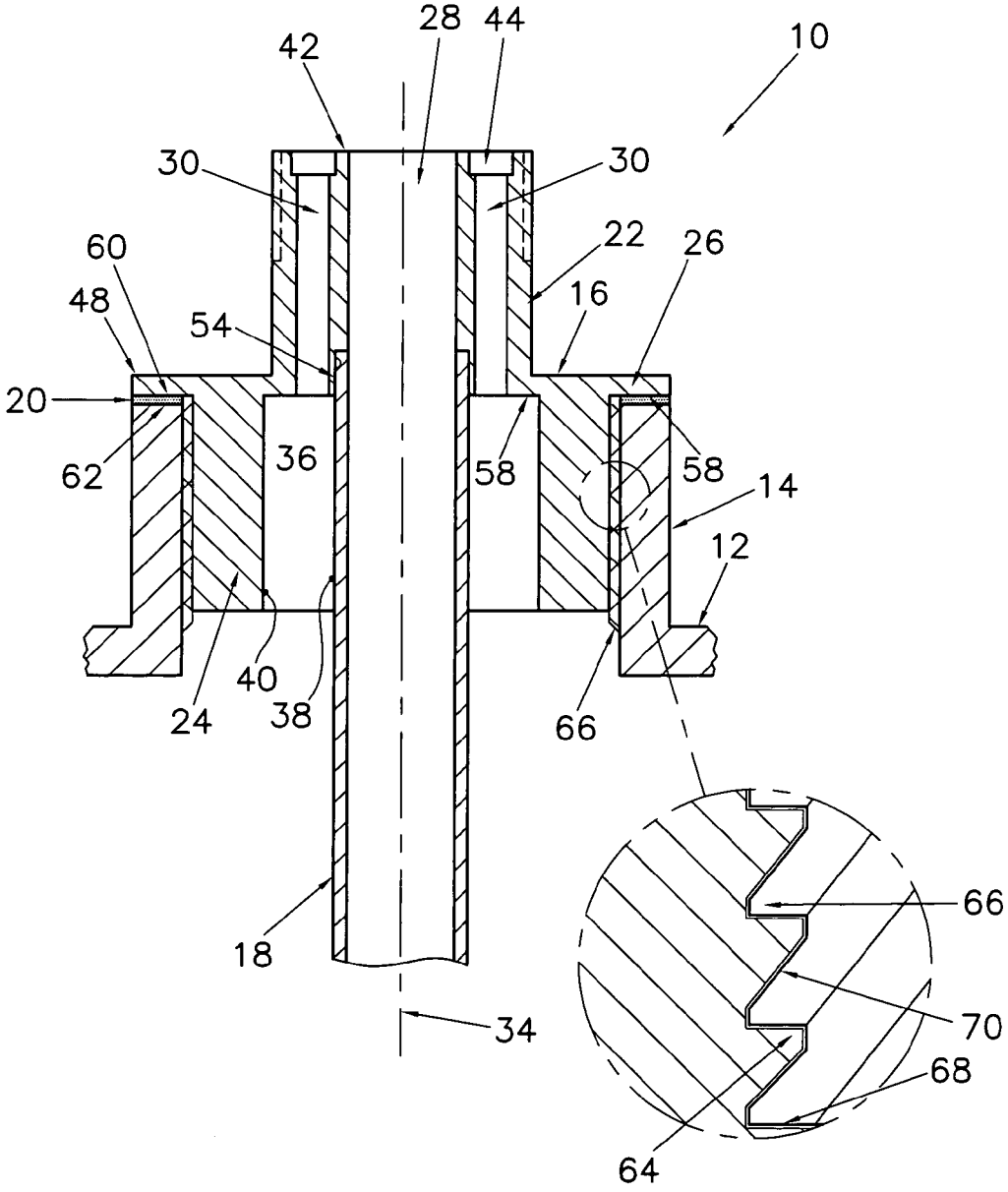
FIG. 3 is a partly cut-off cross-sectional view of the adapter assembly and of a container neck of a packaging container.
Figure 4:
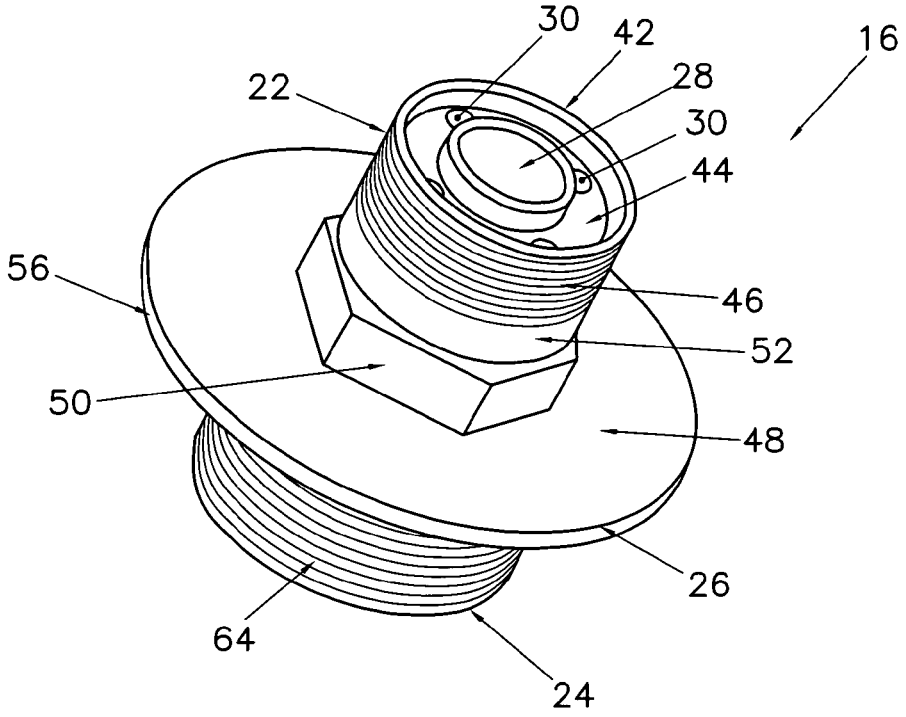
FIG. 4 is a perspective view of an adapter body of the adapter assembly.
Figure 5:
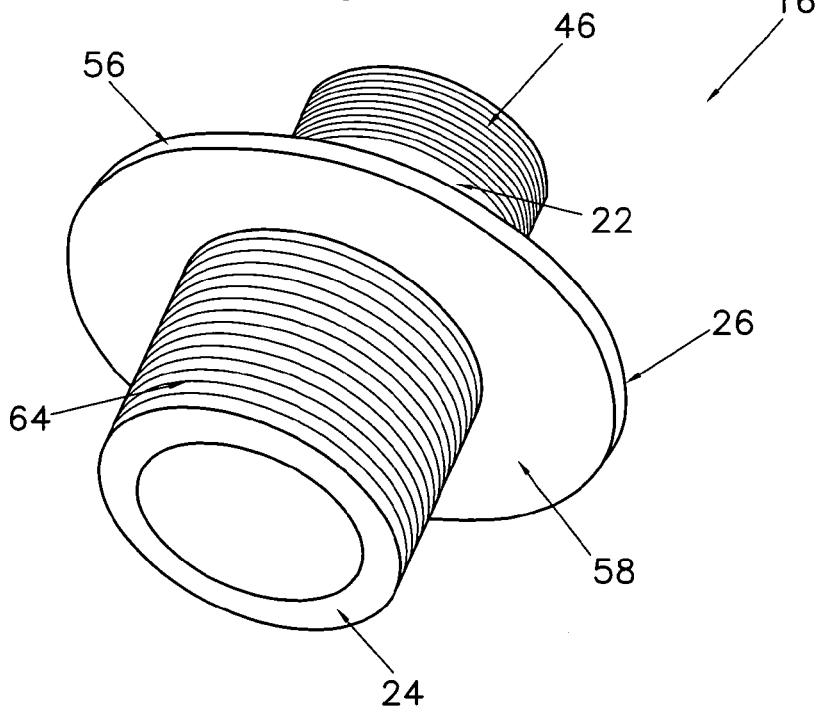
FIG. 5 is another perspective view of the adapter body.
Figure 6:
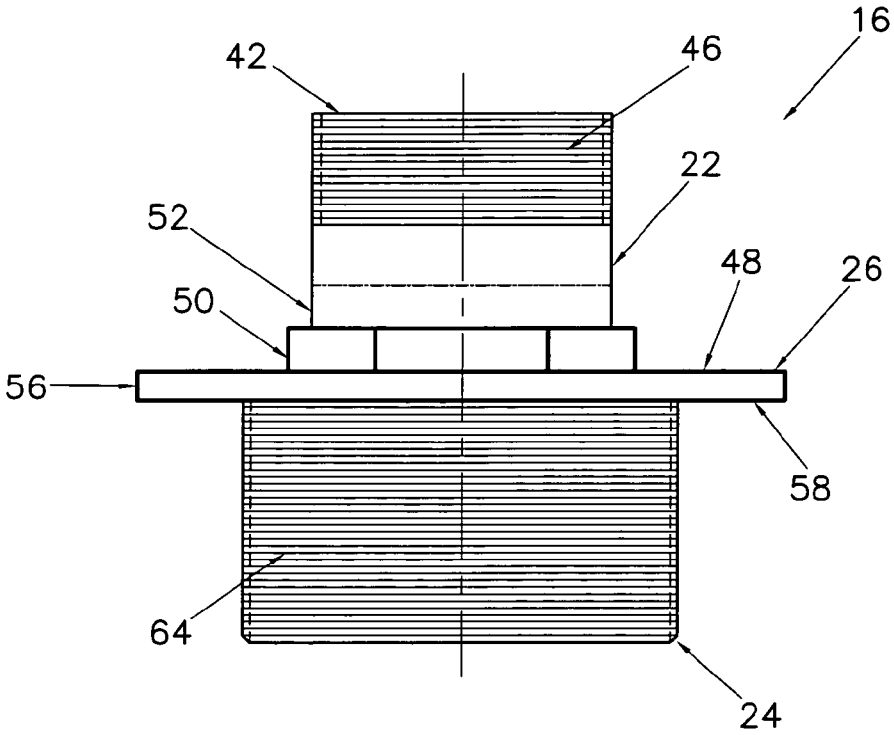
FIG. 6 is a side view of the adapter body.

The present invention is illustrated by reference to the drawing figures, encompassing different views of a preferred embodiment of the invention, wherein:

FIG. 1 is a perspective view of an exemplary adapter assembly according to the present invention for directly dispensing a sterilant from a packaging container;

FIG. 2 is another perspective view of the adapter assembly;

FIG. 3 is a partly cut-off cross-sectional view of the adapter assembly and of a container neck of a packaging container;

FIG. 4 is a perspective view of an adapter body of the adapter assembly;

FIG. 5 is another perspective view of the adapter body;

FIG. 6 is a side view of the adapter body; and

Figure 7:
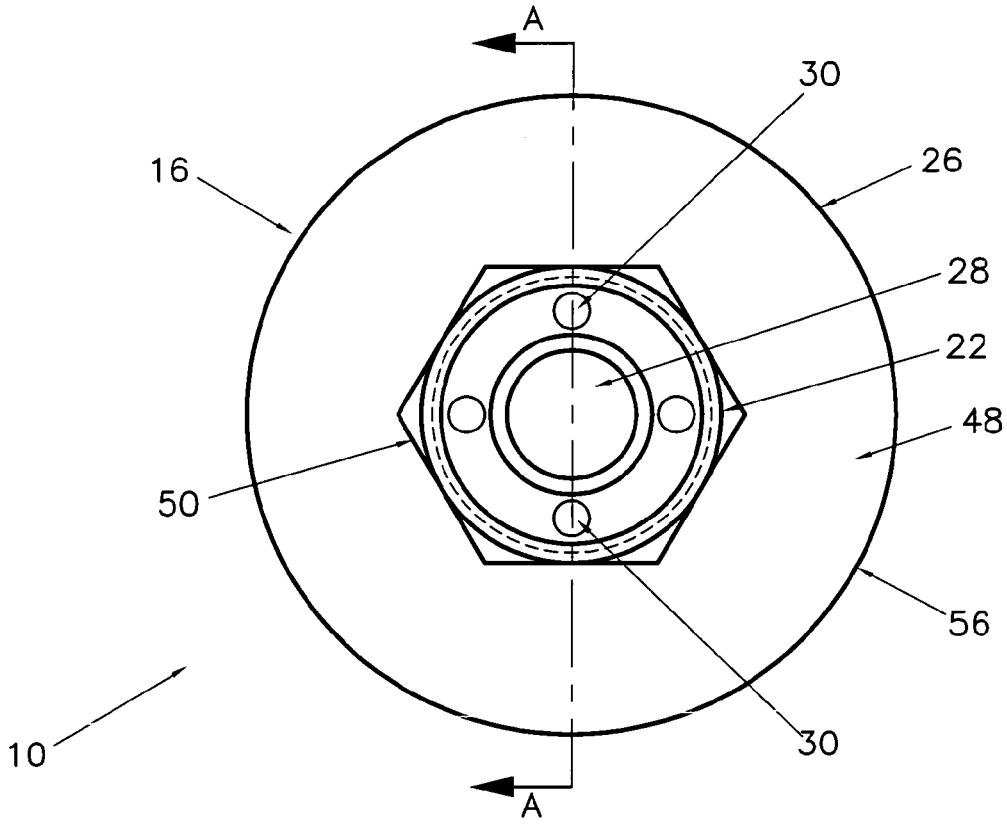
FIG. 7 is a top view of the adapter assembly.

FIG. 7 is a top view of the adapter assembly.

The adapter assembly 10 as best depicted in FIGS. 1 to 3 is used for dispensing a sterilant, particularly hydrogen peroxide, directly from a blow-molded tight-head plastic packaging container 12 (partially shown in FIG. 3) which meets UN packaging type 1H1 requirements and has an internally threaded neck 14 with a container opening, into a packaging system (not shown) for cleaning, in particular sterilizing and filling, in particular aseptic filling of packages, in particular food or beverage packages, such as bottles or laminated carton packages with a food product.

The adapter assembly 10 comprises an adapter body 16, a dip tube 18 attached to the adapter body 16, and a gasket 20.

The unitary adapter body 16 is made of 316 stainless steel and comprises a first tubular body portion 22 with a smaller cross-section, a second tubular body portion 24 with a larger cross-section, and an outwardly projecting collar portion 26 intermediate the first tubular body portion 22 and the second tubular body portion 24. As can be best seen in FIGS. 4 to 6, the projecting collar portion 26 has a larger cross-section than the first and second tubular body portions 22 and 24.

The first tubular body portion 22 is provided with a cylindrical central dispensing passage 28 having a larger inner diameter and four cylindrical venting or pressurizing passages 30, each having a smaller inner diameter. The central dispensing passage 28 and the four venting or pressurizing passages 30 extend axially through the first body portion 22 and through the collar portion 26. The central dispensing passage 28 is coaxial with a longitudinal axis 34 of the adapter assembly 10 and communicates with the interior of the dip tube 18. As can be best seen in FIG. 7, the four venting or pressurizing passages 30 are spaced in 90°-intervals around the dispensing passage 28. The venting or pressurizing passages 30 open into an annular space 36 between a cylindrical outer surface 38 of the dip tube 18 and a cylindrical inner surface 40 of the second tubular body portion 24, as can be best seen in FIG. 3.

At an opposite second end of the first body portion 22, the central dispensing passage 28 extends to a planar end face 42 of the first body portion 22 whereas the four venting or pressurizing passages 30 open into a circular groove 44 which is recessed from the end face 42. Adjacent to the second end the first body portion 22 is provided with an external thread 46 for connecting the adapter body 16 with an interface (not shown) of the aseptic packaging system. Directly adjacent to its first end and to an upper planar surface 48 of the collar portion 26 the first body portion 22 has a zone 50 with a hexagonal exterior cross-section for tightening the adapter assembly 10 with regard to the packaging container 12 after having screwed the second tubular body portion 24 into the internally threaded neck 14 of the packaging container 12. Between the zone 50 with the hexagonal exterior cross-section and the external thread 46 the first tubular body portion 22 is provided with zone 52 with a cylindrical outer surface in order to protect the external thread 46 from potential damages when fitting a wrench to the zone 50 with the hexagonal exterior cross-section.

The first end of the first body portion 22 is provided with a cylindrical socket 54 (FIG. 3) for attachment of the upper end of the dip tube 18. The socket 54 extends to a planar end face 58 of the first tubular body portion 22, is separated from the four venting or pressurizing passages 30, and has an inner diameter which corresponds to the outer diameter of the dip tube 18.

The collar portion 26 has a cylindrical outer periphery 56 with an outer diameter matching the outer diameter of the internally threaded container neck 14. On the side of the second body portion 24 the collar portion 26 has a planar lower surface 58 which is parallel to the upper planar surface 48 and orthogonal to the longitudinal axis 34.

The dip tube 18 is made of 316 stainless steel. Before attaching the dip tube 18 to the adapter body 16, the length of the dip tube 18 can be customized to fit the height of the tight-head packaging container so that the lower end of the dip tube 18 is close to the bottom of the packaging container. For attachment of the dip tube 18 to the adapter body 16, the upper end of the dip tube 18 is introduced into the cylindrical socket 54 in order to provide for alignment of the longitudinal axis 34 of the adapter assembly 10 and the dip tube 18, as best shown in FIG. 3, and then the exterior surface 38 of the dip tube 18 is welded to the planar end face 58 of the first tubular body portion 22. The inner diameter of the dip tube 18 corresponds to the inner diameter of the dispensing passage 28 so that the interior walls of the dip tube 18 and the dispensing passage 28 are aligned with each other.

The gasket 20 is a flat annular elastomer gasket with a planar upper surface 60 and a coplanar lower surface 62. In order to retain the gasket 20 on the second body portion 24 when the adapter assembly 10 is not in use, the upper surface 60 of the gasket 20 is adhered to the planar lower surface 58 of the collar portion 26.

The second tubular body portion 24 has an external thread 64 for engagement with an internal thread 66 of the threaded neck 14 of the packaging container 12. In order to firmly press the collar portion 26 of the adapter body 16 against the gasket 20 and firmly press the gasket 20 against a planar rim of the container opening and to prevent any slack in the engagement of the screw threads 64, 66 of the second tubular body portion 24 and the container neck 14, the external thread 64 of the second tubular body portion 24 is in the form of an external buttress thread which mates with the complementary internal buttress thread 66 on the container neck 14. As can be seen from the enlarged section of FIG. 3, the external buttress thread 64 has two faces 68, 70 where the load bearing face 68 is perpendicular to the screw axis whereas the other face 70 is slanted at 45 degrees to the screw axis.

The use of the adapter assembly 10 is as follows: After the sterilant, e.g., an aqueous solution of hydrogen peroxide, has been delivered from the manufacturer of the sterilant in the above mentioned tight-head plastic packaging container, the bung plug of the packaging container is screwed off from the container neck 14. Then the dip tube 18 of the adapter assembly 10 is introduced through the container opening into the interior of the container until the gasket 20 abuts to the planar rim of the packaging container. Next the external thread 64 of the second tubular body portion 24 is screwed into the internally threaded neck 14 of the packaging container until a tight seal has been achieved. Then an interface of the packaging system is connected with the first body portion 22 by means of the external thread 46. Finally the sterilant is dispensed from the packaging container through the adapter body 16 directly into the packaging system. This can be done either by pumping the sterilant from the packaging container with the aid of a pump installed in the packaging system and connected with the dispensing passage 28 or by applying an overpressure through the interface to the venting or pressurizing passages 30 for displacement of the sterilant.

Although this invention has been described broadly and also identifies specific preferred embodiments, it will be understood that modifications and variations may be made within the scope of the invention as defined by the following claims.

The invention claimed is:

1. An adapter assembly for supplying a sterilant from a packaging container with an internally threaded neck surrounding a container opening and with an externally threaded bung plug for sealing the container opening, into a packaging system for cleaning and filling of packages, the adapter assembly comprising:

a unitary adapter body, a dip tube, and a gasket, wherein:

said unitary adapter body has a first tubular body portion, a second tubular body portion, and a collar portion which is positioned intermediate said first and second tubular body portions for pressing the gasket against the neck of the packaging container, said dip tube is fitted to a first end of said first tubular body portion, said unitary adapter body has a dispensing passage extending through said first tubular body portion and communicating with an interior passage of said dip tube;

said unitary adapter body further has at least one venting or pressurizing passage extending through said first tubular body portion and communicating at the first end of the first body portion with an annular space between an outer surface of said dip tube and an inner surface of said second tubular body portion, said second tubular body portion has an external thread for engagement with the internally threaded neck of the packaging container, and said gasket surrounds said second tubular body portion and abuts to said collar portion.

2. The adapter assembly according to claim 1, wherein said external thread of said second tubular body portion is a buttress thread.

3. The adapter assembly according to claim 1, wherein said first tubular body portion has four venting or pressurizing passages spaced in 90°-intervals.

4. The adapter assembly according to claim 1, wherein said unitary adapter body and said dip tube are made of stainless steel.

5. The adapter assembly according to claim 1, wherein an upper end of said dip tube is welded into a socket at said first end of said first tubular body portion.

6. The adapter assembly according claim 1, wherein a second end of said first tubular body portion opposite from said first end is provided with an external thread.

7. The adapter assembly according to claim 1, wherein a second end of said first tubular body portion opposite from said first end is provided with an annular groove, and wherein said at least one venting or pressurizing passage end in said annular groove.

8. The adapter assembly according to claim 1, wherein said first tubular body portion has a zone with a hexagonal exterior cross-section adjacent said collar portion.

9. The adapter assembly according to claim 1, wherein said first tubular body portion has two flat regions machined therein to use for wrench tightening.

10. A process for supplying a sterilant directly from a packaging container into a packaging system for cleaning and filling of packages, comprising:

providing a sterilant in a packaging container with an internally threaded neck surrounding a container opening and with an externally threaded bung plug for sealing said container opening, removing said externally threaded bung plug from said internally threaded neck of said packaging container, sealingly attaching the adapter assembly according to claim 1 to said packaging container by engagement of said external thread of said second body portion of said adapter body with said internally threaded neck of said packaging container after introducing said dip tube into said container opening, connecting an interface of said packaging system to said first tubular body portion of said adapter body, and supplying said sterilant directly from said packaging container through said adapter body of said adapter assembly into said packaging system.

11. The process according to claim 10, wherein said step of supplying said sterilant directly from said packaging container through said adapter body into said packaging system comprises a step of pumping said sterilant from said packaging container with a pump of said packaging system or a step of applying an overpressure through said interface to said at least one venting or pressurizing passage at a second end of said first tubular body portion of said adapter body for displacing said sterilant from said packaging container.

12. The process according to claims 10, wherein said packaging system is an aseptic packaging system for sterilizing and aseptic filling of packages or an extended shelf-life packaging system.

13. The process according to claim 10, wherein said packaging system is selected from the group consisting of pouches, bottles, and laminated carton packages.

14. The process according to claim 10, wherein said packaging container is a blow-molded tight-head plastic packaging container.

15. The process according to claim 10, wherein said sterilant is selected from the group consisting of acids, ethanol, oxides, and peroxides.

16. The process according to claim 10, wherein said sterilant is selected from the group consisting of ethylene oxide, peracetic acid, and hydrogen peroxide.

17. The adapter assembly according to claim 1, wherein said packaging system is selected from the group consisting of pouches, bottles, and laminated carton packages.

18. The adapter assembly according to claim 1, wherein said packaging container is a blow-molded tight-head plastic packaging container.

19. The adapter assembly according to claim 1, wherein said gasket is a flat annular elastomer gasket.

20. An adapter assembly for supplying a sterilant from a packaging container with an internally threaded neck surrounding a container opening and with an externally threaded bung plug for sealing the container opening, into a packaging system for cleaning and filling of packages, the adapter assembly comprising:

a unitary adapter body having a first tubular body portion, a second tubular body portion having an external thread for engagement with an internally threaded neck of a packaging container, and a collar portion which is intermediate said first and second tubular body portions, a dip tube fitted to a first end of said first tubular body portion, and a gasket, wherein:

said unitary adapter body has a dispensing passage extending through said first tubular body portion and communicating with an interior passage of said dip tube and has at least one venting or pressurizing passage extending through said first tubular body portion and communicating with an annular space between an outer surface of said dip tube and an inner surface of said second tubular body portion, and said gasket surrounds said second tubular body portion, abuts to said collar portion, has a planar upper surface facing a planar lower surface of said collar portion, and has a planar lower surface for abutment with a planar rim surrounding said container opening of said packaging container.

21. The adapter assembly according to claim 1, wherein the at least one venting or pressurizing passage extends from the first end of the first tubular body portion of the unitary adapter body through the first tubular body portion to one or more openings, disposed between the dispensing passage and the outer circumference of the second end of the first tubular body portion, at the second end of the first body portion.

* * * * *